United States Patent [19]

Pfeifer et al.

[11] 4,441,940

[45] Apr. 10, 1984

[54] METHOD FOR PRODUCING TOROIDAL TAPE CORES FOR FAULT CURRENT SAFETY SWITCHES AND USE OF SUCH CORES

[75] Inventors: Friedrich Pfeifer, Bruchkoebel; Willi Kessler, Linsengericht, both of Fed. Rep. of Germany

[73] Assignee: Vacuumschmelze GmbH, Fed. Rep. of Germany

[21] Appl. No.: 291,487

[22] Filed: Aug. 10, 1981

[30] Foreign Application Priority Data

Aug. 19, 1980 [DE] Fed. Rep. of Germany ..... 3031257

[51] Int. Cl.[3] ..... H01F 1/00

[52] U.S. Cl. ..... 148/121; 148/31.55

[58] Field of Search ..... 148/101, 102, 103, 108, 148/120, 121, 122, 31.55, 31.57

[56] References Cited

U.S. PATENT DOCUMENTS

| | | | |
|---|---|---|---|
| 2,891,883 | 6/1959 | Howe | 148/108 |
| 3,125,472 | 3/1964 | Yamamoto et al. | 148/108 |
| 3,546,031 | 12/1970 | Pfeifer et al. | 148/108 |
| 3,657,025 | 4/1972 | Pfeifer | 148/121 |
| 3,871,927 | 3/1975 | Masumoto et al. | 148/121 |

*Primary Examiner*—John P. Sheehan

*Attorney, Agent, or Firm*—Hill, Van Santen, Steadman & Simpson

[57] ABSTRACT

In order to improve the temperature constancy of induction boost in a standard working temperature range for fault current safety switches, a Ni-Mo-Cu-Fe alloy is provided whose nickel and copper content in a binary nickel-copper system is defined by a quadrangle of points A (80.5 wt. % Ni and 0 wt. % Cu), B (82 wt. % Ni and 0 wt. % Cu), C (70 wt. % Ni and 16.5 wt. % Cu) and D (70 wt. % Ni and 14.4 wt. % Cu) and whose molybdenum content, z, in wt. % satisfies the relation:

$$11/30\,(x-68) \leqq z \leqq 11/30\,(x-63.5)$$

with a given Ni content, x, in wt. % and the remainder of which essentially consists of iron and minor processing impurities. Such an alloy is worked into a 0.05 through 0.3 mm thick tape and wound into a toroidal tape core which is first annealed for about 30 minutes at temperatures between 900° and 1200° C. and is then tempered in accordance with its Mo content at the temperatures between 450° and 550° C. in such a manner that the magnetic anisotropy, $K_1$, becomes equal to 0 at temperatures between −5° and +30° C. Such toroidal tape cores are particularly useful as sum current transformer cores or pulse-current-sensitive fault current safety switches, with a trigger current strength of 30 mA.

5 Claims, 12 Drawing Figures

METHOD FOR PRODUCING TOROIDAL TAPE CORES FOR FAULT CURRENT SAFETY SWITCHES AND USE OF SUCH CORES

BACKGROUND OF THE INVENTION

1. Field of the Invention

The invention relates to toroidal tape cores for fault current safety switches and somewhat more particularly to a method of producing such cores wherein a toroidal tape core wound from a 0.05 through 0.3 mm thick tape composed of a Ni-Mo-Cu-Fe alloy is subjected to various thermal treatments in a non-oxidizing atmosphere.

2. Prior Art

Fault current safety switches usually contain a sum current transformer which consists of a magnetic core with primary windings for connection to a circuit being monitored and with a secondary winding. Such secondary winding feeds the excitation winding of a release magnet, influencing a switch latch for a switch device. When an alternating current - fault current occurs in a circuit being monitored, a voltage arises in the secondary winding, to which the release magnet responds. This actuates the switch latch of the switch device and interrupts the circuit being monitored. Magnetic cores composed of a material with high saturation induction and high maximum permeability, given a trigger field strength, i.e., a relatively steep hysteresis loop, are generally employed as sum current transformers for fault current safety switches which are only to respond to alternating current-fault currents. Fault current safety switches with such magnetic cores, however, frequently do not trigger given pulsed dc fault currents, since the change of magnetic flux generated by a pulsed dc in the transformer is not sufficient to induce an adequate voltage in the secondary winding of the transformer to trigger the switch.

Given fault current safety switches which are required to respond to pulsed dc fault currents, as can occur, for example, in circuits with transistor controls, one therefore employs toroidal tape cores composed of so-called F-materials which exhibit a low remanence and a relatively high induction boost. Accordingly, the latter must be so high that a voltage induced in the secondary winding by a pulsating dc fault current flowing in a primary winding of the sum current transformer is adequate for the actuation of the release magnet. Further, a resonant capacitor can also be provided in the secondary circuit (for example see German Pat. No. 2,036,497).

A suitable material for a magnetic core of a sum current transformer for such fault current safety switches can comprise, among other materials, a Ni-Mo-Cu-Fe alloy consisting of 75 through 82 wt. % nickel, 2 through 5.5 wt. % molybdenum and 0 through 5 wt. % copper, with the remainder iron, along with minor amounts of deoxidation and processing additives, which has been subjected to special thermal treatment. In somewhat more detail, a toroidal tape core wound out of a 0.03 through 0.1 mm thick tape composed of the above-described alloy is annealed for 2 through 6 hours at a temperature between 950° and 1220° C., then subjected to a tempering treatment for 1 through 3 hours at a temperature between 450° through 600° C. for setting the state of high initial permeability, and, finally, is subjected to a 1 through 50 hour tempering at a temperature between 250° through 400° C. The tempering preferably occurs in a magnetic field whose field lines in the material being annealed extend at right angles to the later direction of the magnetic flux in the toroidal tape core is, a transverse magnetic field. In addition to a high induction boost, such toroidal tape cores also exhibit a high initial permeability. An induction boost, $\Delta B$, is defined as the difference between the induction, given saturation or maximum level control, for example, given a field strength of 15 mA/cm, and the remanence. The pulse permeability is defined as $\mu_I = \mu_O \Delta B/\Delta H$, wherein $\mu_O$ is the permeability of empty space and $\Delta H$ signifies the field strength boost (see German Auslegeschrift No. 20 44 302; German Pat. No. 1,558,820 or Elektrotechnische Zeitschrift (Electrotechnical Publication) Vol. A-89, 1968, pages 601 through 604, for example).

Specific alloys within the above-described alloy compositions heretofore utilized in fault current safety switches were selected by means of a corresponding inclusion of nickel and copper in such a manner that the magnetostriction, $\lambda_{111}$ in the [111]direction is approximately equal to 0. By means of an annealing treatment and a tempering treatment, a high initial permeability was thereby attained, with a crystal anisotropy $K_1=0$ and, finally, a low remanence was obtained with tempering in a transverse magnetic field. Overall, magnetic cores with low remanence, high pulse permeability and high induction boost were attained which also responded to pulsating direct currents in fault current safety switches.

However, in view of the high unit numbers of such toroidal tape cores that are required, the triple thermal treatment and, the particularly involved tempering in the transverse magnetic field is disadvantageous.

In instances in which a maximum induction boost is not absolutely necessary, under certain conditions one could conceive of simply omitting the tempering in the transverse magnetic field and accepting a higher remanence and a corresponding reduction of induction boost in exchange for less complicated processing procedures. The result would be a rounded hysteresis loop, which would no longer be entirely as flat. However, this, as our own investigations have shown, is not possible with alloys having $\lambda_{111}=0$, previously employed for fault current safety switches, since the induction boost then not only becomes smaller, but is no longer adequate with respect to its temperature constancy.

Namely, it was noted that the induction boost greatly decreases when deviations from that ambient temperature at which $K_1=0$ was precisely set for a respective alloy by means of the tempering treatment and at which, thus, the maximum of the induction boost also lies for the corresponding tempering temperature. If, for example, $K_1=0$ was set to an ambient temperature of 20° C. by a tempering treatment, then the temperature constancy of induction boost, $\Delta B$ results in the fact that the fault current safety switch still responds to a pulsating dc-fault current at an ambient temperature of 20° C. but that, with a change of the ambient temperature either up or down from this value, a change of flux induced in the secondary winding of the sum current transformer no longer suffices in order to trigger the switch as a result of the reduction of induction boost.

SUMMARY OF THE INVENTION

The invention provides a method of producing toroidal tape cores for fault current safety switches in such a manner that the tempering in a transverse magnetic field is eliminated and, nonetheless, the temperature constancy of induction boost is so good that the so-produced fault current safety switches are certain to be triggered due to pulsating dc-fault currents in a standard working temperature range extending from −5° C. through +80° C. and, insofar as possible, even beyond this range.

In accordance with the principles of the invention, the earlier described prior art technique is inventively improved by providing an alloy having a nickel and copper content in a binary nickel-copper system which lies in an area limited by a quadrangle defined by points A (80.5 wt. % Ni and 0 wt. % Cu), B (82 wt. % Ni and 0 wt. % Cu), C (70 wt. % Ni and 16.5 wt. % Cu) and D (70 wt. % Ni and 14.4 wt. Cu) and whose molybdenum content, z, in wt. %, satisfies the relation:

$$11/30(x-68) \leqq z \leqq 11/30(x-63.5) \quad \text{(I)}$$

with a given nickel content, x, in wt. % and the remainder of which essentially consists of iron, along with minor amounts of impurities and usual processing-promoting and deoxidizing additives, working such alloy into a 0.05 through 0.3 mm thick tape and winding such tape into a toroidal tape core which is first annealed for at least about 30 minutes at a temperature between 900° and 1200° C. and is then tempered in accordance with its molybdenum content at temperatures between 450° and 550° C. in such a manner that the magnetic anisotropy, $K_1$, becomes equal to 0 at the temperatures between −5° C. and +30° C.

In contrast to toroidal tape cores composed of alloys with a magnetostriction, $\lambda_{111}=0$, previously utilized in fault current safety switches for pulsating dc-fault currents, the saturation magnetostriction, $\lambda_s$, is set to approximately 0 in the toroidal tape cores produced in accordance with the principles of the invention by means of an appropriate selection of the nickel and copper content in the alloy forming such cores. Stated more precisely, the Ni-Cu content in the inventive alloy lies within the area defined by a quadrangle A-D between $0.5 \cdot 10^{-6}$ and $(-1) \cdot 10^{-6}$. By means of a corresponding adjustment of tempering temperature and molybdenum content, further, the crystal anisotropy $K_1$ is set to approximately 0 for a temperature between −5° C. and +30° C., for example for a temperature of 20° C. With a given nickel content, one requires decreasing tempering temperatures for this purpose, with an increasing molybdenum content. When, with a given nickel content and a given molybdenum content, one reduces the tempering temperature, then the ambient temperature for which $K_1=0$ is also somewhat reduced.

Surprisingly, with toroidal tape cores produced in accordance with the principles of the invention, the induction boost decreases far less in the temperature range between −10° C. and +80° C. than in the case with alloys having $\lambda_{111}=0$, given deviations from the ambient temperature at which $K_1=0$ in the respective case and at which the respective maximum of the induction boost occurs.

In a preferred embodiment of the invention, the toroidal tape core produced from the inventive alloy are first annealed at a temperature ranging between 900° and 1050° C. Although the maximum induction boost with this tempering decreases slightly in comparison to higher tempering temperatures, the dependency of the induction boost on ambient temperature is even further reduced.

In order to have the respective maximum of induction boost occur in the range of predominant operating temperatures of fault current safety switches, in a preferable embodiment, the tempering treatment for toroidal tape cores produced in accordance with the principles of the invention occurs at temperatures between 470° and 520° C., as a function of the molybdenum content (in the alloy forming such core) in such a manner that $K_1$ becomes equal to 0, given a temperature between 0° and 20° C. The expedient duration of a tempering treatment depends on the temperature utilized. Shorter time periods suffice with higher temperatures. For example, given a tempering treatment of 480° C., the tempering treatment should last at least about 30 minutes.

Toroidal tape cores produced in accordance with the principles of the invention are particularly suitable for smaller designs of pulse-sensitive fault current safety switches, i.e., particularly for fault current safety switches with a trigger current strength of 30 mA and for currents of, for example, 25 or 40 A. With less sensitive fault current switches having higher trigger currents, the cores are further level controlled so that one must employ materials having a higher coercive field strength. As a rule, there is less space within a core with switches for higher currents, so that one must reduce the number of windings of the secondary winding and, therefore, cores composed of alloys having higher induction boost are required. Of course, given sufficient space, magnetic cores produced in accordance with the principles of the invention can also be utilized for such fault current safety switches.

Further, toroidal tape cores produced in accordance with the principles of the invention are also useful as sum current transformer cores for fault current safety switches for ac-fault currents in instances where a particularly good temperature compensation is desired.

Further, toroidal tape cores produced in accordance with the principles of the invention are also useful in highly sensitive electronic safety switches, in which a low temperature dependence of permability and a high magnetic stability of the core utilized is required. High stability is defined such that the ratio between remanent permeability and permeability in the de-magnetized state is as close as possible to 1. For example, a safety switch core can achieve the remanent state because of a short-circuit current, after which no triggering at a nominal fault current would occur, given a remanent permeability which was too low.

DESCRIPTION OF THE PREFERRED EMBODIMENTS

Figure 1:
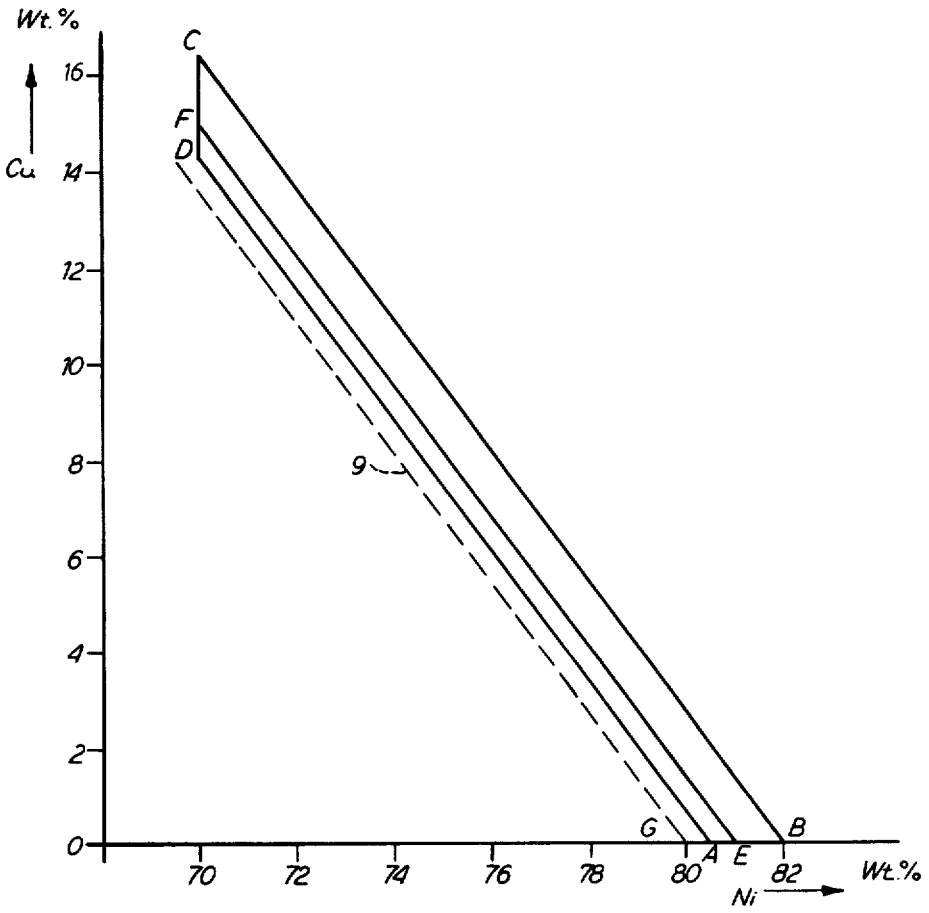
FIG. 1 is a graphical illustration illustrating an excerpt from a binary nickel-copper system from which the alloy compositions in accordance with the principles of the invention are selected.

FIG. 1 graphically illustrates an excerpt from a binary nickel-copper system for nickel-molybdenum-copper-iron alloys. The nickel content is entered along the abscissa and the copper content is entered along the ordinate, respectively, in wt. %. The alloy composition utilized in the practice of the invention lie in the quadrangle defined by points A-D, with A being located at 80.5 wt. % Ni and 0 wt. % Cu, B being located at 82 wt. % Ni and 0 wt. % Cu, C being located at 70 wt. % and 16.5 wt. % Cu and with D being located at 70 wt. % Ni and 14.4 wt. % Cu. The saturation magnetostriction of these alloys is approximately $\lambda_s=0.5\cdot10^{-6}$ along the straight line AD and approximately $\lambda_s=(-1)\cdot10^{-6}$ along the straight line BC. The alloy compositions whose saturation magnetostriction, $\lambda_s$, is approximately equal to 0 lie on or, respectively, in the immediate vicinity of the straight line EF, proceeding through point E (81 wt. % Ni and 0 wt. % Cu) parallel to the straight line AD and BC. Thus, $\lambda_s \geqq 0$ to the left of the straight line EF and $\lambda_s \leqq 0$ to the right of the straight line EF. Alloy compositions heretofore employed in toroidal tape cores for fault circuit safety switches lie beyond the quadrangle ABCD, on or respectively, in direct proximity of the straight line g extending through the point G (80 wt. % Ni and 0 wt. % Cu), parallel to the straight lines AD and BC. Line g is shown in broken lines and approximately corresponds to a magnetostriction $\lambda_{111}=0$.

Figure 2:
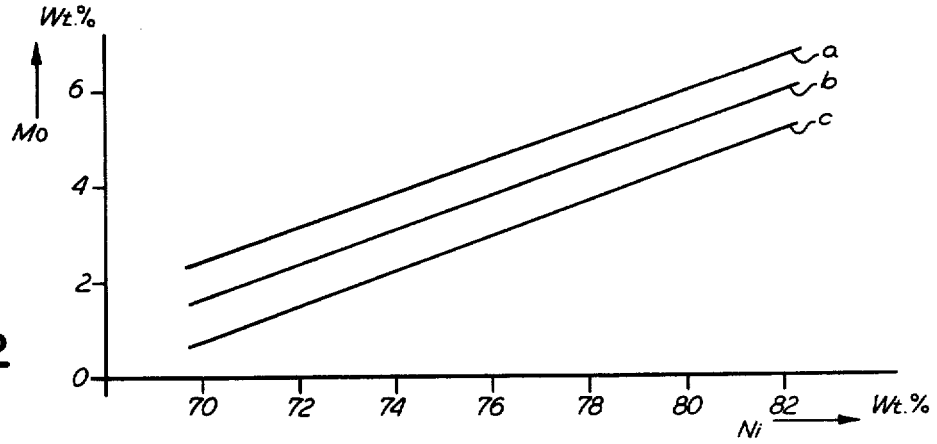
FIG. 2 is a schematic illustration of a Ni-Mo system illustrating the Mo content of alloys at which $K_1$ becomes approximately 0 at 20° C. with a given Ni content, depending on the tempering temperature utilized.

FIG. 2 illustrates a corresponding excerpt from a binary nickel-molybdenum system for alloys used in the practice of the invention with 70 through 80 wt % Ni. In this illustration, the nickel content is again indicated along the abscissa and the molybdenum content is indicated along the ordinate, respectively in wt. %. The individual lines a, b and c approximately correspond to the molybdenum content belonging to the respective nickel content at which the crystal anisotropy $K_1$ of the corresponding alloy is approximately equal to 0, measured at an ambient temperature of 20° C., with the tempering temperature as a parameter. In further detail, the straight line a corresponds to a tempering temperature of approximately 450° C.; line b corresponds to a tempering temperature of approximately 480° C.; and line c corresponds to a tempering temperature of approximately 550° C. The areas lying between the straight lines a, b and c correspond to tempering temperatures which lie in between the values given above.

As can be seen from FIG. 2, the tempering temperature at which one can attain $K_1 \approx 0$ tends to decrease with an increasing molybdenum content, given a selected nickel content. If x defines the nickel content in wt. % and z indicates the molybdenum content in wt. %, the straight line equation $x-30/11z-C=0$ corresponds to the straight lines a, b and c wherein C is approximately 63.5 for line a, approximately 65.5 for line b, and approximately 68.0 for line c. With a given nickel content x, the relation:

$$11/30(x-68) \leqq z \leqq 11/30(x-63.5) \quad \text{(I)}$$

is attained for molybdenum amounts z lying between the lines a and c.

If, given a selected nickel and molybdenum content, one selects a lower tempering temperature than is required for $K_1=0$ at 20° C., then the ambient temperature at which $K_1=0$ also becomes somewhat lower. Inversely, the ambient temperature at which one attains $K_1=0$ increases with increasing tempering temperature above the value necessary to attain $K_1=0$ at 20° C. Even when an ambient temperature is chosen between −5° C. and 30° C. at which $K_1=0$ should occur and which deviates from 20° C., one still usually remains within the limits set by lines a and c in FIG. 2, with respect to the molybdenum content of the alloy.

In addition to the primary alloy components of nickel, copper, molybdenum and iron, the alloys utilized in the practice of the invention, as already mentioned, can also contain (leaving minor impurities out of consideration), minor amounts of standard process-promoting and deoxidizing additives, preferably manganese in amounts up to, at most, 1 wt. % and silicon in amounts up to, at most, about 0.5 wt. %. Manganese amounts up to approximately 0.5 wt. % and silicon amounts ranging between 0.1 and 0.3 wt. % are preferred. The amount of standard contaminants in the alloys should be as low as possible.

With the foregoing general discussion in mind, there is now presented detailed exemplary embodiments which will illustrate to those skilled in the art the manner in which this invention is carried out. However, these exemplary embodiments are not to be construed as limiting the scope of the invention in any way.

The influence of alloy composition as well as of the annealing and tempering temperatures on the properties which are essential for the inventive use of such alloys in toroidal tape cores of pulse-sensitive fault current safety switches are illustrated by way of exemplary embodiments set forth below on the basis of various alloy compositions. The alloy compositions are set forth in Table 1 below in wt. %. Alloys 1 through 12 comprise exemplary embodiments of alloy compositions useful in the practice of the invention and alloy 13 is a comparative alloy with $\lambda_{11} \approx 0$.

Each of the alloys listed in Table 1 were melted in a conventional manner in vacuum. The individual alloy ingots so-obtained were hot-rolled to a thickness of 7 mm and then, with interposition of intermediate annealings at temperatures between 800° and 1100° C., were cold-rolled to a final thickness of 0.08 mm.

Each of the tapes manufactured in that manner was cut into strips 22 mm wide. Toroidal tape cores having an outside diameter of 25 mm, an inside diameter of 17.5 mm and a height of 22 mm, corresponding to the tape width, were produced from such tapes in a conventional manner. These cores were then annealed for approximately 5 hours in a hydrogen atmosphere at temperatures ranging between 900° through 1150° C and were then tempered for approximately 2 hours, likewise in a hydrogen atmosphere, at a temperature ranging between 450° through 550° C. After tempering, the cores were allowed to cool in air in order to freeze-in the tempering state.

The static induction boost, $\Delta B_{stat}$, and the dynamic induction boost, $\Delta B_{dyn}$, were respectively determined for the toroidal tape cores manufactured in the above-described manner, given a field strength amplitude $\hat{H}=15$ mA/cm. For this purpose, each toroidal tape core was provided with an excitation winding and with a measuring winding and an alternating current was supplied to the excitation winding. The induction boost measured with a supply of single-wave rectified alternating current, was designated as the static induction boost and the induction boost measured with a supply of full-wave rectified alternating current was designated as the dynamic induction boost. Measurements were conducted at various temperatures ranging between −20° C. through +80° C., in order to determine the dependency of ΔB on the measuring temperature and, thus, to also determine the dependency of ΔB on the different operating temperatures occurring in fault current safety switches. Further, the dependency of ΔB on the tempering temperature was also determined at given room temperature, i.e., 20° C. A selection from the measured results is illustrated in FIGS. 3-10 and set forth in Table 2 below.

Figure 3:
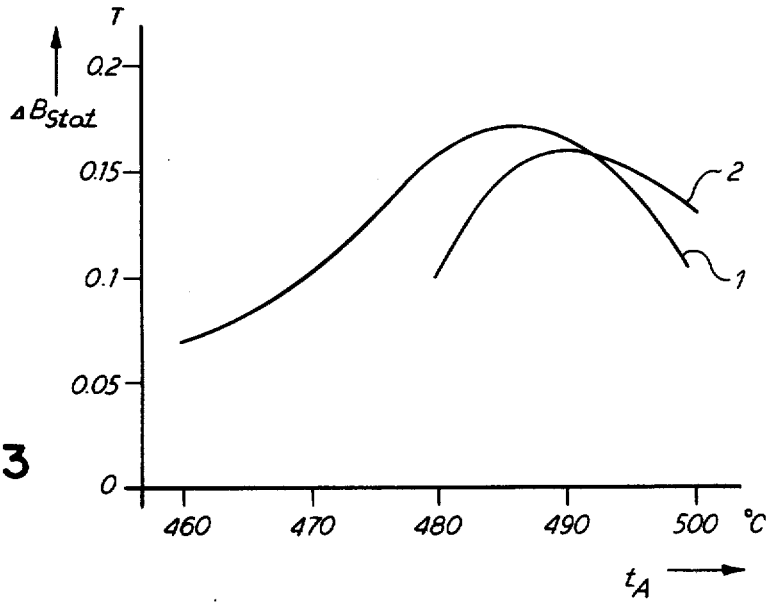
FIGS. 3 and 4 are graphical illustrations illustrating the static or respectively, the dynamic induction boost at 20° C. for an exemplary embodiment of an alloy utilized in the practice of the invention, as a function of tempering temperature.
Figure 4:
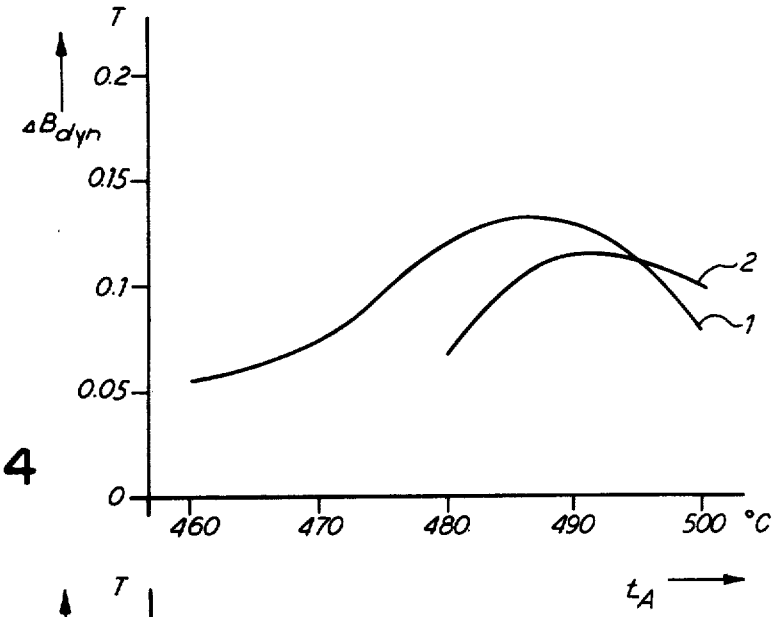

The dependency of $\Delta B_{stat}$ or, respectively, $\Delta B_{dyn}$ on the tempering temperature $t_A$, is illustrated in FIGS. 3 and 4, measured at 20° C. The respective tempering temperature is entered along the abscissa in ° C. and ΔB is entered along the ordinate in Tesla.

Curves 1 were measured for alloy No. 1 while curves 2 were measured for the comparative alloy No. 13. Both alloys were subjected to an annealing treatment at 1150° C. before the tempering treatment. A maximum of ΔB was respectively attained in curves 1 at a tempering temperature of approximately 485° C. This maximum corresponds to that state in which, at 20° C., $K_1$ is equal to 0. If, thus, having cores from alloy No. 1 annealed at 1150° C., one wishes to set $K_1=0$ for an ambient temperature of 20° C., then one must temper such cores produced from this alloy at approximately 485° C. Analogous situations apply to the remaining alloys in whose case the tempering temperature required for setting $K_1=0$ at 20° C., can be analogously determined by determining the maximum of ΔB at 20° C. as a function of the tempering temperature.

Figure 5:
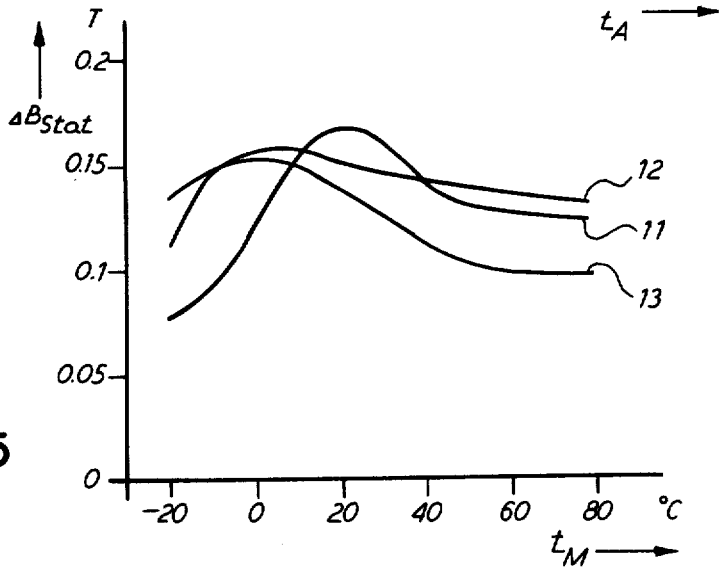
FIGS. 5 and 6 are graphical illustrations showing the dependency of the static or, respectively, the dynamic induction boost on ambient temperature at measurements for an exemplary embodiment of an alloy utilized in the practice of the invention and various tempering temperatures.
Figure 6:
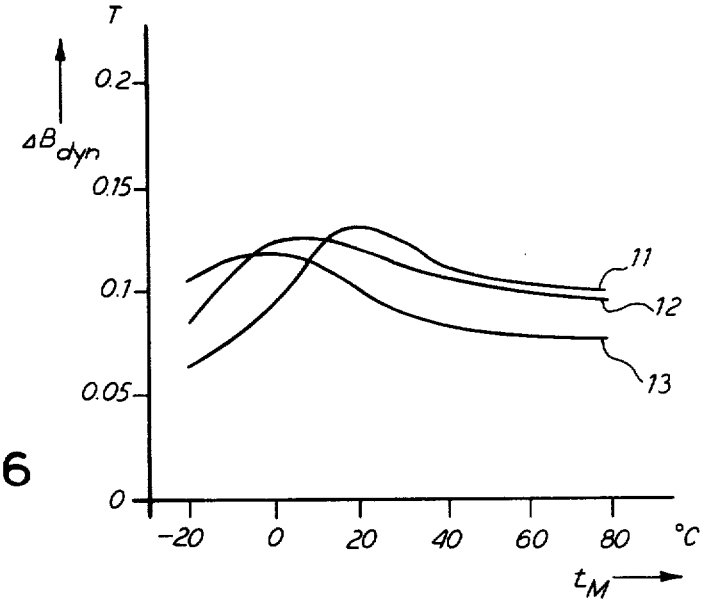

In FIGS. 5 and 6, $\Delta B_{stat}$ or, respectively, $\Delta B_{dyn}$ are illustrated for alloy No. 1 which was subjected to an annealing at 1150° C. as a function of the measuring temperature, $t_M$, i.e., the ambient temperature prevailing during the measurement, namely, for three different tempering temperatures. The measuring temperature $t_M$, is entered in ° C. along the abscissa and ΔB is entered in Tesla along the ordinate. Curves 11 correspond to a tempering temperature of 485° C.; curves 12 correspond to a tempering temperature of 480° C.; and curves 13 correspond to a tempering temperature of 475° C. The maxima of the curves respectively correspond to the ambient temperature at which $K_1=0$. It can be clearly seen that this temperature is shifted from 20° C. toward 0° C. with a decreasing tempering temperature. Thus, with a given alloy, one can set $K_1=0$ for various ambient temperatures by a different selection of tempering temperatures. Although, at 20° C., ΔB is reduced to lower temperatures, given the shift of $K_1=0$, such a shift can nevertheless be favorable because, as FIGS. 5 and 6 illustrate, a relatively flat course or path of the ΔB curves can thereby be attained and thus a reduction of the temperature dependency of ΔB on the ambient temperature attained. If, for example, one wishes to achieve the greatest possible independence of $\Delta B_{dyn}$ in the temperature range from −20° C. through +80° C., then curve 13 is favorable, whereas curve 12 is recommended only if one places value on a temperature range from −5° C. through +80° C.

Figure 7:
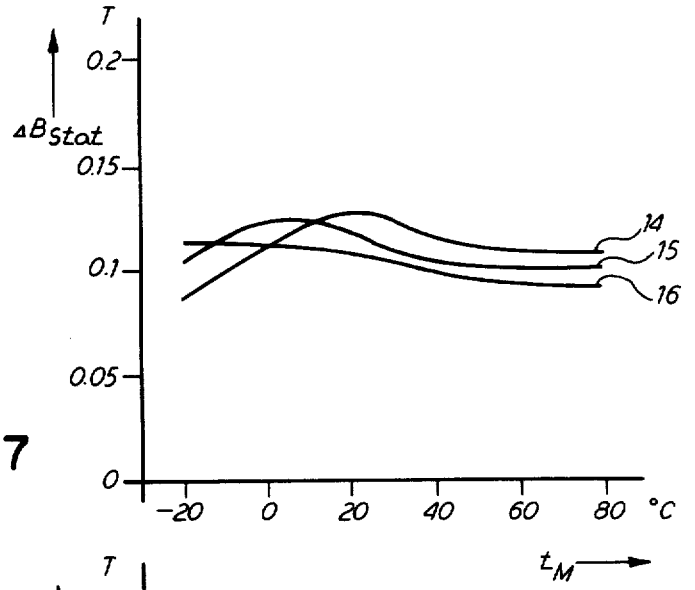
FIGS. 7 and 8 are graphical illustrations indicating the corresponding dependency for an identical exemplary alloy embodiment, however, at lower tempering temperatures.
Figure 8:
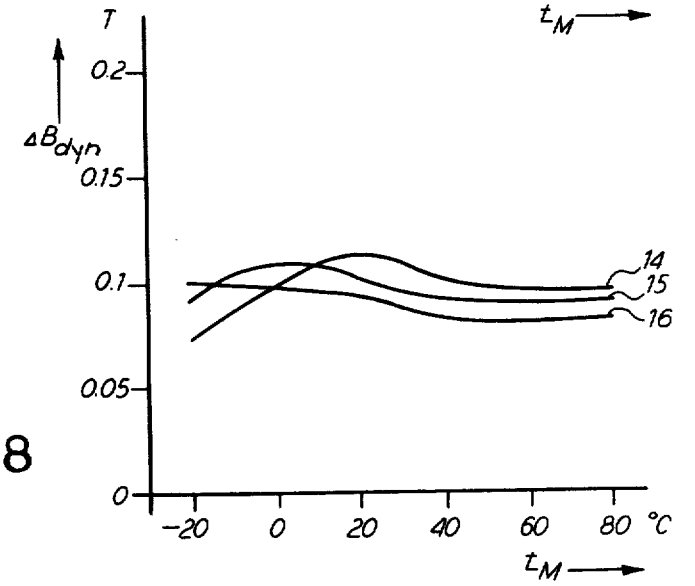

$\Delta B_{stat}$ and $\Delta B_{dyn}$ of alloy No. 1 are again illustrated in FIGS. 7 and 8 as a function of the measuring temperature, $t_M$, but now for a toroidal tape core which was subjected to a 5 hour annealing treatment at 950° C. before the tempering treatment. Curves 14 correspond to a tempering temperature of 485° C.; curves 15 correspond to a tempering temperature of 480° C. and curves 16 correspond to a tempering temperature of 475° C. Here again one can clearly see that the maxima of ΔB and thus, the state with $K_1=0$, is shifted toward lower temperatures when the tempering temperature is reduced. As a comparison with FIGS. 5 and 6 shows, the maximum induction boost with reduction of annealing temperature indeed decreases, however the ΔB curves become even flatter and the dependency of ΔB on the ambient temperature is even further reduced. In curves 16, the maximum of ΔB is shifted to temperatures of −20° C. or lower. Although curves 16 extend very flatly and at first seem very favorable because of the low temperature dependency, the maximum of ΔB stops beyond the range of standard operating temperatures for fault current safety switches due to the shift and the ΔB values of primary interest are already relatively greatly lowered at higher temperatures. A shift of the maximum of ΔB and, thus, of $K_1=0$ for a temperature below −5° C., would therefore be less favorable for fault current safety switch cores.

Figure 9:
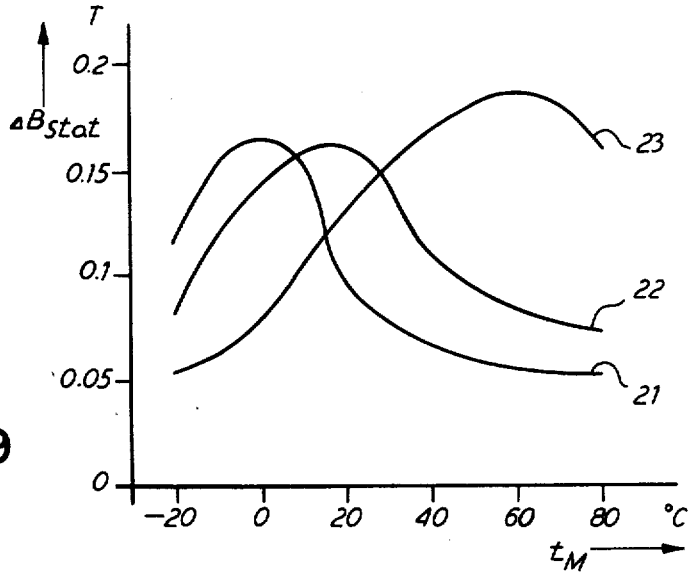
FIGS. 9 and 10 graphically illustrate the corresponding dependency of a comparative alloy.
Figure 10:
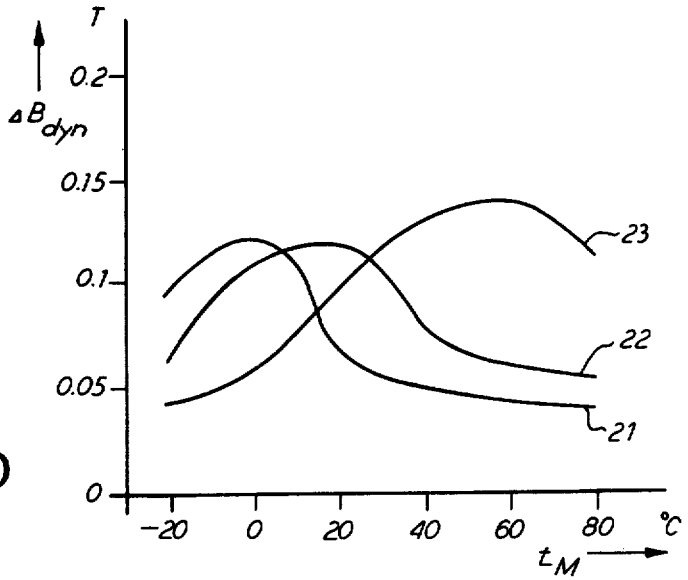

Finally, FIGS. 9 and 10 illustrate $\Delta B_{stat}$ and $\Delta B_{dyn}$ of comparative alloy No. 13 as a function of the measuring temperature. The annealing treatment occurred at 1150° C. Curve 21 corresponds to a tempering temperature of 480° C.; curve 22 corresponds to a tempering temperature of 490° C. and curve 23 corresponds to a tempering temperature of 500° C. In comparison to FIGS. 5 through 8, the very strong dependency of ΔB in the comparative alloy on the ambient temperature is directly indicated. Comparative alloy No. 13 is therefore not suitable, without tempering in a transverse magnetic field, for toroidal tape cores of pulse-sensitive fault current safety switches.

Some of the measured results derived from FIGS. 3 through 10 as well as the measured results of further alloys are numerically compiled in Table 2 below. In the individual columns of this Table, the alloy number, the annealing temperature, the tempering temperature and the temperature at which $K_1=0$ was approximately set by the tempering treatment are shown. Further columns of Table 2 contain $\Delta B_{stat}$ and $\Delta B_{dyn}$ at 20° C. in Tesla, as well as the ratios proceeding from these, respectively measured for a field amplitude $\hat{H}=15$ mA/cm. Further, the ratios $\Delta B_{dyn}(t_M)/\Delta B_{dyn}(20° C.)$ for $t_M=-5°$ C., 80° C. and −20° C. are given as a measure for the temperature independence of ΔB.

It can be seen from Table 2 that conditions essentially analogous to those already explained above in conjunction with FIGS. 3-10 also exist for the further alloys listed in the Table.

Given toroidal tape cores for pulse-sensitive fault current safety switches with a trigger current strength of 30 mA and for currents of 25 or 40 A, $\Delta B_{dyn} \geqq 0.08$ T, preferably $\geqq 0.1$ T, should prevail at 20° C. for a mean level control of 15 mA/cm. Temperature stability has proven sufficient when $\Delta B_{dyn}(t_M)/\Delta B_{dyn}(20° C.) \geqq 0.75$ applies for $t_M = -5°$ C. and $t_M = 80°$ C. Further, at 20° C., $\Delta B_{stat}/\Delta B_{dyn}$ should preferably be $\leqq 1.3$.

As the data in Table 2 shows, these conditions can be essentially met with alloy composition Nos. 1 through 12 by proper matching of an alloy composition and a thermal treatment with one another in such a manner that $K_1 = 0$ at a temperature between $-5°$ C. and 30° C. In the case of most of the alloy compositions, the aforesaid condition for temperature stability is also met for $t_M = -20°$ C. In contrast thereto, conditions for temperature stability cannot be met with comparative alloy composition No. 13, as has already been shown on the basis of FIGS. 9 and 10.

The alloy compositions listed in Tables 1 and 2 predominantly lie in a preferred range between approximately 4 and 5 wt. % copper within the quadrangle ABCD in FIG. 1. In other words, these alloy compositions preferably lie between the straight lines AD and EF. However, the measured results set forth in Table 2 for alloy compositions No. 7 through 10 show that the alloys or alloy compositions lying in the remaining area of the quadrangle in ABCD are also useful for toroidal tape cores of pulse-sensitive fault current safety switches. It should also be pointed out that the saturation induction of alloy compositions No. 1 through 12 extend between approximately 0.60 and 0.67 T, respectively measured at a level control of 1 A/cm. The saturation induction of comparative alloy No. 13 is, on the other hand, 0.75 T.

As was previously mentioned, toroidal tape cores produced in accordance with the principles of the invention are also useful as sum current transformer cores of fault current safety switches for ac-fault currents. What is generally required of such fault current safety switches is that a change of inducation at an operating point should be $< \pm 20\%$ relative to the value at 20° C. within a temperature range between $-5°$ C. and 80° C. and also, at least partially, between $-10°$ C. and 80° C. However, there is a tendency to demand a corresponding temperature constancy up to $-25°$ C. Here, too, toroidal tape cores produced in accordance with the principles of the invention are useful, as can be seen from FIG. 11.

Figure 11:
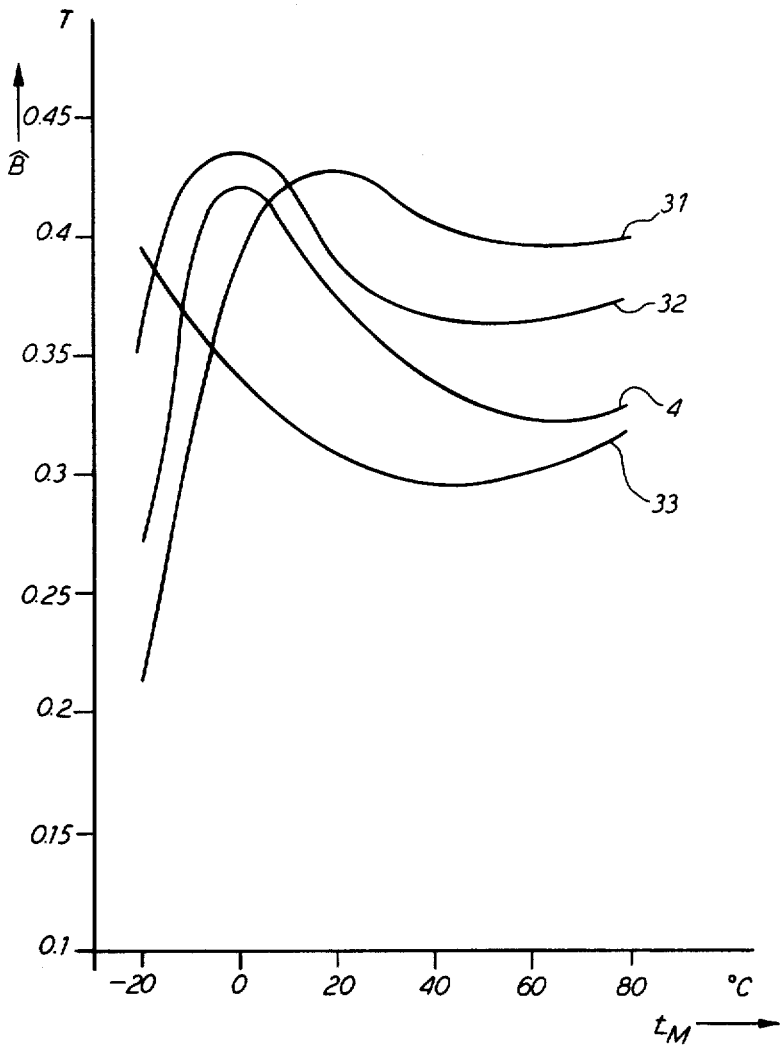
FIG. 11 graphically illustrates the dependency of induction on ambient temperature during measurement of an exemplary alloy embodiment of the invention at various tempering temperatures.

In FIG. 11, the dependency of induction $\hat{B}$, on the temperature is illustrated for alloy composition No. 6, measured with an effective field amplitude of 5.5 mA/cm. The measuring temperature $t_M$ is entered along the abscissa and the induction $\hat{B}$, is entered in Tesla along the ordinate. The measurements were carried out on toroidal tape cores which had first been annealed for 5 hours at 1150° C. and had then been tempered for 2 hours at different temperatures. Curve 31 corresponds to a tempering temperature of 475° C.; curve 32 corresponds to a tempering temperature of 470° C.; and curve 33 corresponds to a tempering temperature of 465° C. Again, the shift of the maximum of the induction from 20° C. toward 0° C. or, respectively toward $-20°$ C. with a decreasing tempering temperature is apparent. Although a decrease of induction at 20° C. is connected therewith, the condition of a temperature constancy of $\pm 20\%$ over practically the entire temperature range between $-25°$ C. and 80° C. is met by curve 32 with an induction maximum at 0° C.

For purposes of comparison, curve 4 is also shown at FIG. 11, which was measured for a toroidal tape core composed of a comparative alloy having $\lambda_{111} \approx 0$. The toroidal tape core of this alloy which consisted of 77.0 wt. % Ni, 4.4 wt. % Cu, 3.9 wt. % Mo, 0.47 wt. % Mn, 0.14 wt. % Si, with the remainder Fe, was first annealed for 5 hours at 1150° C. and was then tempered for 2 hours at 480° C. in order to set the maximum of induction at 0° C. As is apparent, curve 4 decreases considerably faster at lower and higher temperatures than does curve 32. Thus, the demand for temperature constancy cannot be met with this comparative alloy.

Figure 12:
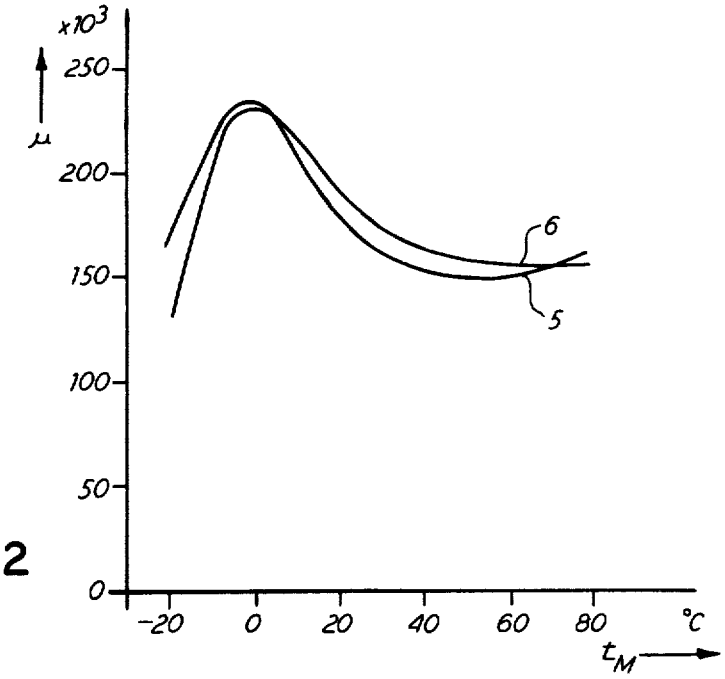
FIG. 12 graphically illustrates the dependency of permeability on ambient temperature during measurement of an exemplary alloy embodiment of the invention.

Further, toroidal tape cores produced in accordance with the principles of the invention are also useful for highly sensitive electronic safety switches. Toroidal tape cores for such switches must exhibit a high magnetic stability in addition to a low temperature dependence of permeability. High stability is defined as the ratio of remanent permeability to permeability in the de-magnitized state and which should be as close as possible to 1. For example, a safety switch core can proceed into a remanent state due to a short-circuit current. When the remanent permeability, i.e., the permeability measured at the remanence point, is too low, no triggering occurs with a nominal fault current. Measured at a level control of 1.5 mA/cm, curve 5 in FIG. 12 shows the relative permeability, $\mu$, for a toroidal tape core composed of alloy No. 6 as a function of ambient temperature. The measuring temperature $t_M$ is again entered along the abscissa and the permeability $\mu$ is entered along the ordinate. The toroidal tape core whose characteristic values were plotted for curve 5, was first annealed for 5 hours at 1000° C. and then tempered for 2 hours at 470° C. in order to set a maximum of $\mu$ at 0° C. Curve 6 represents the characteristic values of a toroidal tape core composed of a comparative alloy with $\lambda_{111} \approx 0$ consisting of 76.7 wt. % Ni, 4.35 wt. % Cu, 3.85 wt. % Mo, 0.42 wt. % Mn, 0.15 wt. % Si, with the remainder Fe. After a 5 hour annealing treatment at 1000° C., this toroidal tape core was tempered for 2 hours at 480° C. Although curves 5 and 6 appear to be largely coincident, nevertheless, curve 6 decreases more sharply at lower temperatures than does curve 5. The temperature constancy of alloy No. 6 is therefore better than that of the comparative alloy. However, it is of particular significance that the stability, i.e., the ratio of permeability at the remanence point and the permeability in the de-magnetized state, is 0.76 at 20° C. for the toroidal tape core composed of alloy No. 6 but is only 0.47 for the toroidal tape core composed of the comparative alloy. Accordingly, the stability of the toroidal tape core produced in accordance with the principles of the invention is considerably higher than that of the toroidal tape core composed of the comparative alloy. Toroidal tape cores produced in accordance with the principles of the invention are thus particularly useful in electronic safety switches.

TABLE 1

| Alloy | Ni | Cu | Mo | Mn | Si | Fe |
|---|---|---|---|---|---|---|
| 1 | 77.8 | 4.4 | 4.42 | 4.45 | 0.15 | Remainder |
| 2 | 77.7 | 4.5 | 4.72 | 0.46 | 0.13 | " |
| 3 | 77.55 | 4.5 | 4.4 | 0.48 | 0.2 | " |
| 4 | 77.45 | 4.65 | 4.16 | 0.5 | 0.15 | " |
| 5 | 77.2 | 4.55 | 4.35 | 0.5 | 0.15 | " |
| 6 | 77/4 | 4,5 | 4.4 | 0.49 | 0.14 | " |

TABLE 1-continued

| Alloy | Ni | Cu | Mo | Mn | Si | Fe |
|---|---|---|---|---|---|---|
| 7 | 76.85 | 6.0 | 4.05 | 0.5 | 0.15 | " |
| 8 | 78.25 | 4.50 | 4.75 | 0.5 | 0.15 | " |
| 9 | 80.95 | 0 | 5.75 | 0.5 | 0.15 | " |
| 10 | 72.95 | 11.2 | 2.6 | 0.5 | 0.15 | " |
| 11 | 77.4 | 4.55 | 4.40 | 0.51 | 0.11 | " |
| 12 | 77/6 | 4.45 | 4.42 | 0.47 | 0.12 | " |
| 13 | 76.9 | 4.5 | 3.9 | 0.51 | 0.14 | " |

TABLE 2

| Alloy No. | Annealing temp. °C. | Tempering temp. °C. | Temp. $K_1 = 0$ °C. | $\Delta B_{stat}$ T | $\Delta B_{dyn}$ T | $\Delta B_{stat}/\Delta B_{dyn}$ | $\Delta B_{dyn}(t_M)/\Delta B_{dyn}(20° C.)$ $t_M = -5°$ C. | $t_M = 80°$ C. | $t_M = -20°$ C. |
|---|---|---|---|---|---|---|---|---|---|
| 1 | 1150 | 475 | 0 | 0.14 | 0.10 | 1.4 | 1.2 | 0.77 | 1.08 |
| | 1150 | 480 | 5 | 0.15 | 0.12 | 1.23 | 1.0 | 0.79 | 0.67 |
| | 1150 | 485 | 20 | 0.17 | 0.135 | 1.26 | 0.65 | 0.76 | 0.46 |
| | 950 | 475 | −20 | 0.11 | 0.092 | 1.22 | 1.08 | 0.85 | 1.05 |
| | 950 | 480 | 0 | 0.12 | 0.10 | 1.2 | 1.07 | 0.90 | 0.90 |
| | 950 | 485 | 20 | 0.13 | 0.11 | 1.18 | 0.82 | 0.86 | 0.64 |
| 2 | 1150 | 460 | −5 | 0.13 | 0.10 | 1.3 | 1.2 | 0.75 | 1.15 |
| 3 | 1150 | 480 | 0 | 0.12 | 0.10 | 1.2 | 1.25 | 0.80 | 1.0 |
| 4 | 1150 | 510 | 20 | 0.16 | 0.125 | 1.28 | 0.88 | 0.80 | 0.64 |
| | 950 | 500 | −5 | 0.12 | 0.10 | 1.2 | 1.1 | 0.85 | 1.1 |
| | 950 | 505 | 10 | 0.13 | 0.11 | 1.18 | 0.95 | 0.86 | 0.86 |
| | 950 | 510 | 20 | 0.14 | 0.12 | 1.17 | 0.81 | 0.83 | 0.67 |
| 5 | 950 | 475 | 5 | 0.12 | 0.10 | 1.2 | 0.95 | 0.85 | 0.88 |
| | 950 | 480 | 10 | 0.12 | 0.105 | 1.14 | 0.95 | 0.86 | 0.76 |
| | 950 | 485 | 20 | 0.13 | 0.11 | 1.18 | 0.77 | 0.91 | 0.64 |
| 6 | 950 | 475 | 0 | 0.132 | 0.11 | 1.2 | 1.0 | 0.95 | 0.91 |
| | 950 | 480 | 30 | 0.132 | 0.115 | 1.14 | 0.8 | 0.93 | 0.76 |
| 7 | 1115 | 497 | 20 | 0.135 | 0.115 | 1.14 | 0.87 | 0.99 | 0.74 |
| | 1000 | 503 | 0 | 0.13 | 0.115 | 1.13 | 1.04 | 0.87 | 0.74 |
| 8 | 1115 | 480 | 0 | 0.13 | 0.106 | 1.23 | 1.04 | 0.92 | 0.82 |
| | 1000 | 480 | 20 | 0.118 | 0.104 | 1.13 | 0.94 | 0.94 | 0.89 |
| 9 | 1115 | 497 | 15 | 0.132 | 0.114 | 1.16 | 0.79 | 0.79 | 0.53 |
| 10 | 1115 | 472 | 10 | 0.16 | 0.128 | 1.25 | 0.95 | 0.88 | 0.72 |
| 11 | 950 | 485 | 10 | 0.13 | 0.118 | 1.1 | 0.93 | 0.83 | 0.78 |
| 12 | 950 | 485 | 10 | 0.138 | 0.12 | 1.15 | 0.92 | 0.81 | 0.75 |
| 13 | 1150 | 480 | 0 | 0.10 | 0.068 | 1.47 | 1.78 | 0.62 | 1.38 |
| | 1150 | 490 | 15 | 0.16 | 0.12 | 1:36 | 0.86 | 0.47 | 0.54 |
| | 1150 | 500 | 60 | 0.13 | 0.10 | 1.30 | 0.55 | 1.13 | 0.42 |

As is apparent by the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, accepting as it is set forth and defined in the hereto-appended claims.

We claim as our invention:

1. A method of producing torodial tape cores for fault current safety switches with a relatively high dynamic induction boost, $B_{dyn}$, at least 0.08 T and, simultaneously, a relatively high temperature constancy of $B_{dyn}$ in the temperature range of about −5° to +80° C. from a toroidal tape core wound out of a 0.05 through 0.3 mm thick tape composed of a Ni-Mo-Cu-Fe alloy such core being subject to thermal treatment in a non-oxidizing atmosphere, said method comprising of:

employing as said alloy a composition having an Ni and Cu content in a binary Ni-Cu system which is defined by an area bounded by a quadrangle of points A (80.5 wt. % Ni and 0 wt. % Cu), B (82 wt. % Ni and 0 wt. % Cu), C (70 wt. % Ni and 16.5 wt. % Cu), and D (70 wt. % Ni and 14.4 wt. % Cu), and having a Mo content, z, in wt. % which satisfies the relation:

$$11/30(x-68) \leqq z \leqq 11/30(x-63.5)$$

with a given Ni content, x, in wt. %. and the remainder consisting essentially of Fe along with minor amounts of impurities and usual processing-promiting and deoxidizing additives;

said thermal treatments in said non-oxidizing atmosphere consisting of annealing said core for at least about 30 minutes at a temperature ranging between 900° and 1200° C., and thereafter tempering said so annealed tape core in accordance with its Mo content at a temperature ranging between 450° and 550° C. in such a manner that the magnetic anisotropy $K_1$, thereof becomes equal to 0 at a temperature between −5° and +30° C.

2. The method as defined in claim 1 wherein said toroidal tape core produced from such alloy is annealed at a temperature ranging between 900° and 1050° C.

3. The method as defined in claim 2 wherein said annealed tape core is tempered at a temperature ranging between 470° and 520° C. as a function of the Mo content of the alloy forming said tape core in such a manner that $K_1$ thereof becomes equal to 0 at a temperature between 0° and 20° C.

4. The method as defined in claim 1 wherein said annealed tape core is tempered at a temperature ranging between 470° and 520° C. as a function of the Mo content of the alloy forming said tape core in such a manner that $K_1$ thereof becomes equal to 0 at a temperature between 0° and 20° C.

5. A toroidal tape core for an electronic safety switch, and for fault current-sensitive safety switches, with a relatively high dynamic induction boost, $B_{dyn}$, at least 0.08 T and, simultaneously, a relatively high temperature constancy of $B_{dyn}$ in the temperature range of about $-5°$ to $+80°$ C.; said core having been wound out of a 0.05 through 0.3 mm thick tape composed of Ni-Mo-Cu-Fe alloy, such core having been subjected to thermal treatment in a non-oxidizing atmosphere, said alloy having a Ni and Cu content in a binary Ni-Cu system which is defined by an area bounded by a quadrangle of points A (80.5 wt. % Ni and 0 wt. % Cu), B (82 wt. % Ni and 0 wt. % Cu), C (70 wt. % Ni and 16.5 wt. % Cu), and D (70 wt. % Ni and 14.4 wt. % Cu), and having a Mo content, z, in wt. % which satisfies the relation:

$$11/30(x-68) \leqq z \leqq 11/30(x-63.5)$$

with a given Ni content, x, in wt. %, and the remainder consisting essentially of Fe along with minor amounts of impurities and usual processing-promoting and deoxidizing additives;

said thermal treatment in said non-oxidizing atmosphere consisting of first annealing said core for at least about 30 minutes at a temperature ranging between 900° and 1200° C., and thereafter tempering said so annealed tape core in accordance with its Mo content at a temperature ranging between 450° and 550° C. in such a manner that the magnetic anisotropy $K_1$, thereof becomes equal to 0 at a temperature between $-5°$ and $+30°$ C.

* * * * *